US006205650B1

(12) United States Patent
Enoch et al.

(10) Patent No.: US 6,205,650 B1
(45) Date of Patent: Mar. 27, 2001

(54) METHOD OF PRODUCING AND ELECTRICAL SWITCH

(75) Inventors: Claus Enoch, Køge; Flemming Jacobsen, Herlev, both of (DK)

(73) Assignee: MEC A/S, Ballerup (DK)

( * ) Notice: Subject to any disclaimer, the term of this patent is extended or adjusted under 35 U.S.C. 154(b) by 0 days.

(21) Appl. No.: 08/981,096

(22) PCT Filed: Jun. 12, 1996

(86) PCT No.: PCT/DK96/00257

§ 371 Date: Feb. 12, 1998

§ 102(e) Date: Feb. 12, 1998

(87) PCT Pub. No.: WO96/42097

PCT Pub. Date: Dec. 27, 1996

(30) Foreign Application Priority Data

Jun. 13, 1995 (DK) ..... 0675/95

(51) Int. Cl.[7] ..... H01H 11/00

(52) U.S. Cl. ..... 29/622; 29/756; 29/884; 200/5 A

(58) Field of Search ..... 29/622, 756, 884, 29/883, 412; 200/5 A

(56) References Cited

U.S. PATENT DOCUMENTS

| | | | | |
|---|---|---|---|---|
| 2,910,766 | * | 11/1959 | Pritikin | 29/412 |
| 3,781,976 | * | 1/1974 | Tomiwa | 29/25.42 |
| 3,967,370 | * | 7/1976 | Griffin et al. | 200/5 A |
| 4,118,859 | * | 10/1978 | Busler | 29/622 |
| 4,250,367 | * | 2/1981 | Rossi | 200/5 A |
| 4,803,316 | | 2/1989 | Hayashi et al. . | |
| 4,894,500 | | 1/1990 | Yamazaki et al. . | |
| 5,060,372 | * | 10/1991 | Capp et al. | 29/883 |
| 5,666,112 | * | 9/1997 | Crowley et al. | 29/622 |

FOREIGN PATENT DOCUMENTS

| | | |
|---|---|---|
| 2505120 | 8/1976 | (DE) . |
| 3542953A1 | 4/1986 | (DE) . |
| 3540639A1 | 5/1986 | (DE) . |
| 0030473 | 6/1981 | (EP) . |
| 0155390 | 9/1985 | (EP) . |
| 0329968 | 8/1989 | (EP) . |
| 0395561A1 | 10/1990 | (EP) . |
| 0401544B1 | 12/1990 | (EP) . |
| 0411331A2 | 2/1991 | (EP) . |
| 0558239A1 | 9/1993 | (EP) . |
| 0558301A1 | 9/1993 | (EP) . |
| 0564230A1 | 10/1993 | (EP) . |
| 0626706A1 | 11/1994 | (EP) . |
| 2518355 | 6/1983 | (FR) . |
| 2280785 | 2/1995 | (GB) . |

* cited by examiner

*Primary Examiner*—Lee Young
*Assistant Examiner*—A. Dexter Tugbang

(57) ABSTRACT

A method of producing an electrical switch wherein material is cut out of a sheet or web (1) of electrically conductive material such that a plurality of sets of terminals (5, 6, 7) are formed integral with the sheet (1). A housing (not shown) is moulded onto each set of terminals such that the inner terminals (7) are within the housing. Operative elements are mounted in the housing. The moulding of the housings and the mounting of the elements are performed on a plurality of sets of terminals simultaneously. The individual switches are separated from the sheet (1) either by severing the terminals 5 at 15 and 25 and the terminals 6 at 16, thereby forming a switch with a short distance (fx 4 mm) between the terminal ends of terminals (16), or by severing the terminals 6 at 16 and 26 and the terminals 5 at 15, thereby forming a switch with a longer distance (fx 6 mm) between the terminal ends of terminal (15). Hereby a switch for being mounted in an array of either 4×4 mm or 6×6 mm may optionally be produced with the same equipement and in the same process.

12 Claims, 3 Drawing Sheets

METHOD OF PRODUCING AND ELECTRICAL SWITCH

Figure 1:
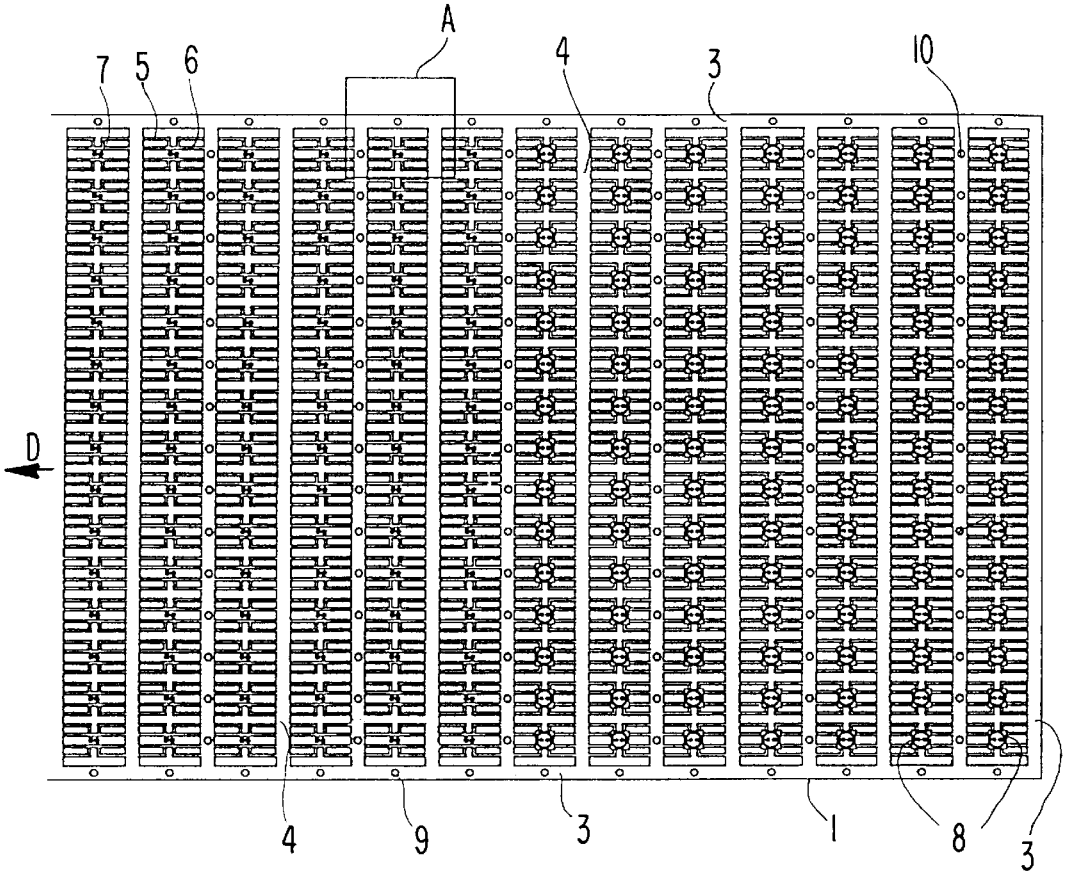

This application claims the benefit under 35 U.S.C. §371 of prior PCT International Application No. PCT/DK96/00257 which has an International filing date of Jun. 12, 1996 which designated the United States of America, the entire contents of which are hereby incorporated by reference.

The present invention relates to a method of producing an electrical switch comprising a housing at least partially enclosing switching means for cooperating with a set of at least two metallic terminals, each terminal having an exterior portion outside the housing and an interior portion inside the housing.

In relation to switches of this type it is extremely important to reduce the manufacturing costs. Any factor that increases the number of switches produced in a given period of time with the same personnel, factory space and discrete units of production equipment is essential for the competitiveness of the finished switch in the marketplace.

It is therefore an object of the present invention to provide a method of producing such switches in which such an increased production capacity is obtained as compared with prior art methods.

A method for producing keyboard switches is known from European Patent No. 0 329 968 in which a single row of sets of metallic terminals is punched out of a strip of the base metal of the terminals, a housing is moulded around each set of terminals, switching means are installed in each housing and each set of terminals is thereafter separated from the strip. In this method the necessary moulding and installing operations are confined to a single production track defined by the single row of sets in the strip.

A method for producing push button switches is known from U.S. Pat. No. 4,803,316 in which two parallel rows of sets of terminals are punched out of a strip, and a housing frame is moulded on each set whereafter the sets are separated from the strip and processed individually for installing the switching means. In this method the individual processing of each discrete set of terminals with attached housing frame requires a number of additional handling steps for insertion in, guidance through, removal from and transportation between the various work stations corresponding to the subsequent steps of installing the switching means in each individual and discrete housing frame.

So as to be able to form the sets, attach the housings to the sets, install the switching means in the housings and finally separate the sets from the sheet all in more than one product ion track while the sets still are interconnected in the sheet, the method according to the invention comprises:

providing a substantially planar sheet of the base metal of said terminals, removing port ions of the sheet so as to form within the boundaries thereof at least two rows of said sets of metallic terminals and so that each terminal remains attached to the sheet solely at the end of the exterior portion of each terminal farthest from the interior portion thereof, attaching a housing to each of the sets in the sheet, installing a switching means in each of the housings, and separating said end of each of the exterior portions of each set provided with a housing and a switching means from the sheet.

Preferably, a housing is attached to each of one or more sets in each of all the rows substantially simultaneously, and a switching means is subsequently installed in each of the housings in one or more steps, each of said steps being performed in one or more housings of each of all the rows substantially simultaneously.

When the housings consist of a mouldable plastic material, the housings are preferably attached to each set by being moulded around the metallic terminals of the set.

So as to utilize the material of the sheet of base metal as efficiently as possible, the sets are preferably disposed in the sheet in an array constituted by substantially parallel, rectilinear rows of sets extending in a first direction and by further substantially parallel, rectilinear rows of sets extending in a second direction substantially at right angles to the first direction.

Preferably, apertures for guiding and positioning the sheet during the steps of attaching the housing, installing the switching means and separating the sets from the sheet are provided along the edges of the sheet and in at least some of the regions between the sets.

In cases where the same switch can be used for two or more applications it is advantageous that the same production method and equipment can be used for manufacturing the switch for all such applications and therefore according to the invention each set of terminals may comprise at least two sub-sets, each sub-set corresponding to a different application of the switch, the method comprising a further step in which at least a portion adjacent said end of the exterior portion of each of the terminals of the sub-set or sub-sets of each set not relevant for the current application of the switch is separated from the rest of the terminal and thereby from the completed switch.

The method of production according to the invention can advantageously be used for a variety of different switches such as rotary switches, toggle switches, on-off switches etc. The method is particularly advantageous in connection with keyboard switches. A currently very utilized keyboard switch is square and has outer dimensions of 6 mm by 6 mm, and the free ends of the terminals of such a switch correspond to the connection points of printed circuit boards designed for such switches. To create more room for other components connected to the printed circuit board it is advantageous that the keyboard switch have smaller dimensions, for instance 4 mm by 4 mm. To enable his smaller switch to be used both with printed circuit boards designed for the larger switches and with printed circuit boards designed for the smaller ones, the housing of the keyboard switch has, according to the invention, a square section in a plane parallel to the plane of the sheet, the exterior dimensions of the square section being 4 mm wide and 4 mm long, and the set of terminals comprising a first sub-set corresponding to an application, for example exterior printed circuit board electrical connections, of a keyboard switch with a square section with exterior dimensions of 6 mm by 6 mm, and a second sub-set corresponding to an application, for example exterior printed circuit board circuit connections, of a keyboard switch with a square section with exterior dimensions of 4 mm by 4 mm.

To further reduce production time and thereby increase the throughput with given means as regards personnel, space and production units it is advantageous to reduce the number of separate elements in the switching means, and therefore it is advantageous to apply the method according to the invention to a keyboard switch wherein the switching means of the keyboard switch comprise a contact element for electrically interconnecting at least two of the terminals in a first position of said contact element and interrupting said electrical interconnection in a second position, an activating element for moving the contact element from its second to its first position, a resiliently deformable member arranged for cooperation with the activating element such that it is resiliently deformed when the contact element is in its first position and is undeformed when the contact element is in its second position, and a key element connected to the activating element, said key element being arranged for being operated by a fingertip of a user of the keyboard, the activating element, the deformable member and the key element constituting an integral unit made from a resiliently deformable material such as silicone rubber.

To further reduce the number of steps to be performed during the installation of the switching means, the contact element, prior to installing the switching means in the housing, is preferably fixedly attached to said unit, for instance by partially embedding it in the material of the unit.

Preferably, the sheet of base metal is substantially rectangular, the rows of sets of terminals being substantially parallel to the sides of the rectangle.

In some applications it is advantageous that the sheet constitutes a strip that can be wound on and off a roll.

The invention further relates to an electrical switch produced by a method according to any of the appended claims 1–14.

In a further aspect of the invention it relates to an electrical switch according to any of the appended claims 15–22.

Figure 2:
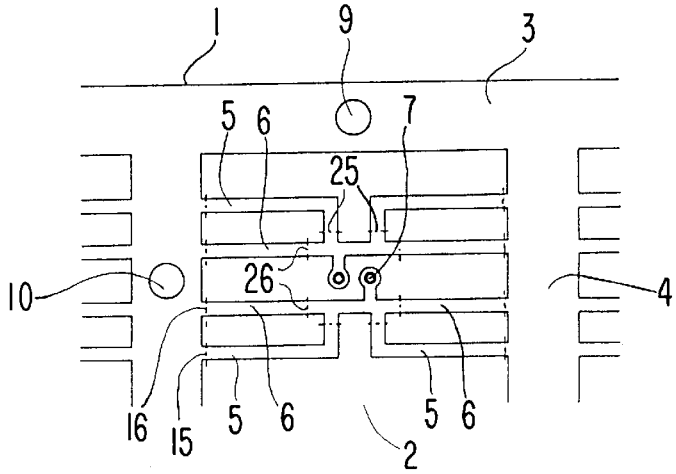
Figure 3:
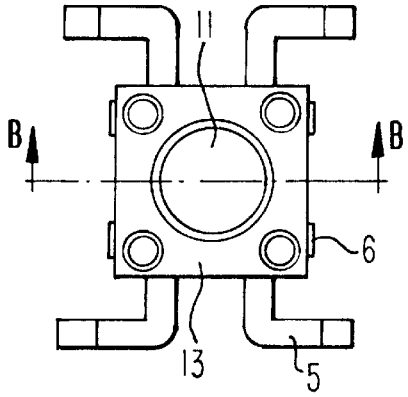
Figure 6:
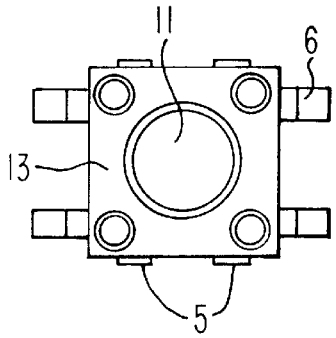
Figure 4:
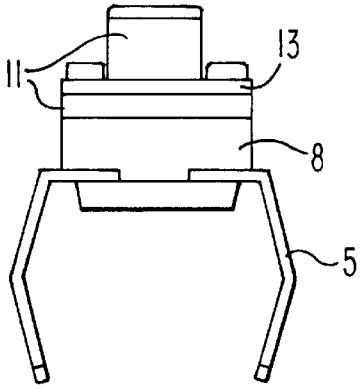
Figure 7:
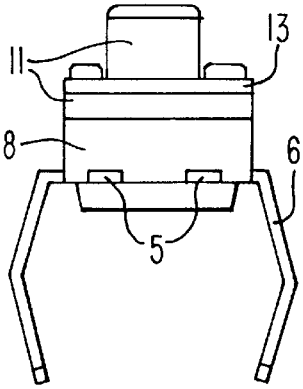
Figure 5:
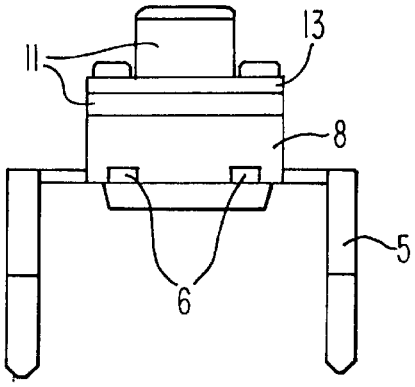
Figure 8:
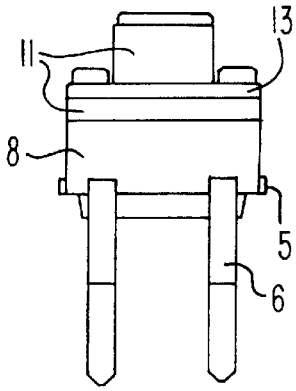
Figure 9:
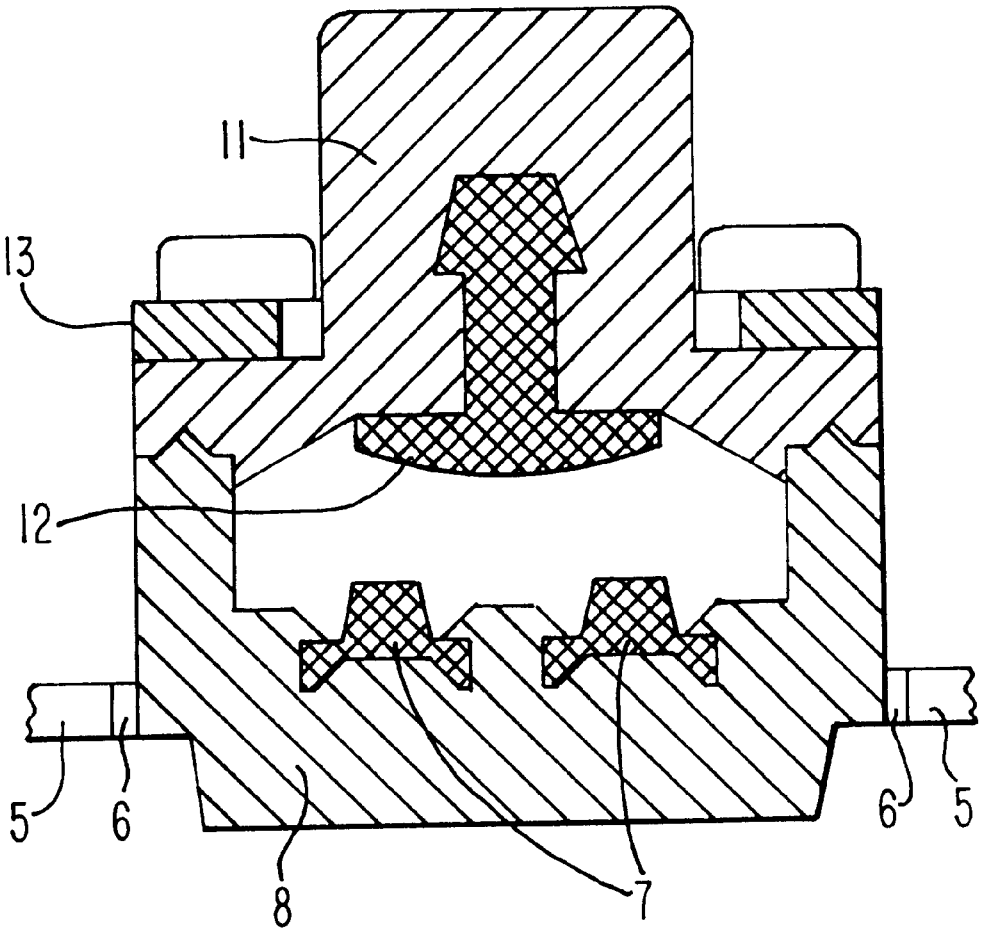

The invention will be described more in detail in the following with reference to the drawings where:

FIG. 1 shows a plan view of an embodiment of a sheet of base metal with sets of terminals and housings of a keyboard switch according to the invention, FIG. 2 shows an enlarged view of the region of the sheet in FIG. 1 enclosed in the square indicated by A in FIG. 1, FIG. 3 shows a top view of a completed switch produced by means of the sheet shown in FIG. 1. the outer portions of a first sub-set of terminals being removed, FIG. 4 shows a side elevational view of the switch shown in FIG. 3, FIG. 5 shows a second side elevational view of the switch shown in FIGS. 3 and 4, FIG. 6 shows a top view of a completed switch produced by means of the sheet shown in FIG. 1, the outer portions of a second sub-set of terminals being removed, FIG. 7 shows a side elevational view of the switch shown in FIG. 6, FIG. 8 shows a second side elevational view of the switch shown in FIGS. 6 and 7, and FIG. 9 shows a cross section along line B—B in FIG. 3.

A substantially planar sheet 1 of an electrically conductive metal such as a tin-bronze coated with silver is subjected to a punching process whereby the configuration shown in FIGS. 1 and 2 is formed. An array of sets of terminals generally indicated by the reference number 2 are disposed in two series of mutually orthogonal rows within the boundaries of the sheet defined by narrow strips 3. Transverse strips 4 interconnect the strips 3 extending in the longitudinal direction of the sheet 1 indicated by the arrow D.

Each of the sets 2 comprise four terminals 5 and four terminals 6, each of the terminals 5 and 6 being at one end thereof attached to a respective transverse strip 4. At their opposite end, the terminals 5 and 6 are connected to each other in pairs and are connected to a respective circular contact nib 7 which in said punching process is formed such that it projects out of the plane of the sheet 1.

After having been subjected to the punching process the sheet 1 is subjected to an injection moulding process in which an array of fifteen by seven housings 8 of a plastic, electrically insulating material are simultaneously moulded around the terminals 5 and 6 of corresponding sets of same. One such array is shown in FIG. 1.

The sheet 1 has a length corresponding to a multiple of such arrays and may comprise a small number of such arrays in case it is desirable to work with a plurality of discrete sheets 1 in the various steps of the production process, and the sheet 1 may comprise a large number of such arrays in case it is desirable to work with a continuous strip that may be wound on a roll for transport between and feeding into the various work stations or extend as a continuous strip between the work stations in which the various production steps are carried out. In all cases the sheet must be advanced to bring a new area thereof into the work station and thereafter the sheet must be fixedly positioned correctly in the work station. Therefore, during the said punching process, apertures 9 and 10 are punched in the longitudinal strips 3 and the transverse strips 4, respectively, the apertures 9 serving primarily to advance the sheet and the apertures 10 serving to position it.

After the housings 8 have been moulded around or unto the sets 2 of terminals 5 and 6 the arrays are moved to a switching means installation work station either by transporting discrete sheets 1 individually or in stacks to said work station or by feeding a continuous sheet 1 into the work station from the moulding station or via an intermediate roll on which the continuous sheet 1 is wound.

In the said work station, fifteen moulded unitary push button snap activating elements 11 are inserted substantially simultaneously in fifteen corresponding housings each from a different longitudinal row in the sheet 1 but not necessarily in the same transverse row. The activating element 11 consists of a resiliently deformable material such as silicone rubber. A contact element 12 consisting of a tin-bronze coated with silver is partially embedded in the activating element 11 during the moulding thereof. The unitary activating element 11 has an upper portion projecting upwards relative to the housing and intended to serve as a key element to be depressed by the fingertip of a user of the switch. The dome shaped lower region of the activating element 11 allows the contact element to be displaced from its inactive position shown in FIG. 9 to its active position in which it is in contact with both the contact nibs 7 when downward pressure is applied to the upper region of the activating element 11.

The dome shape of said lower region entails a snap effect when the downward pressure builds up sufficiently to overcome the dome resistance so that a buckling of the dome shaped lower region of the activating element 11 takes place whereafter the contact element 12 electrically interconnects the two contact nibs 7 immediately after the user has felt the snap effect.

After the activating element 11 has been installed the sheet is moved to a cover installation work station where a stainless steel cover 13 is arranged on the activating element 11 and is fixed to the housing by means of fastening members 14 that may be rivets, screws or projections of the housing cooperating with corresponding apertures in the cover 13 and the activating element 11, the fastening members 14 securing the activating element 11 relative to the housing 8. This step is also carried out substantially simultaneously on fifteen switches, one from each longitudinal row of the sheet 1.

In a subsequent terminal separation work station the terminals 5 and 6 are separated from the sheet 1 at points indicated by dotted lines 15 and 16, respectively, thereby separating the completed switches from the sheet 1 and each other. Depending on the application of the switch, i.e.

whether the application corresponds to utilization of the terminals 5 (FIGS. 3–5) or the terminals 6 (FIGS. 6–8), the outer portion of the terminals 6 or 5, respectively, are separated from the switch at points indicated by dotted lines 26 and 25, respectively.

The terminals 5 or 6 may be bent to the required shape as shown in FIGS. 3–8 in a bending work station included in the terminal separation work station such that the terminals not relevant for the application in question are not separated from the sheet 1 until after the relevant terminals have been separated from the sheet 1 and have been bent into the correct shape in the bending work station.

These final steps are each also carried out substantially simultaneously on fifteen switches one each from each longitudinal row.

Naturally, a different number of simultaneously processed switches can be chosen for the different manufacturing steps depending on the methods chosen for performing the activities comprised by the steps.

EXAMPLE

The sheet 1 consists of silver plated tin-bronze with a thickness of 0.35 mm. The outer portions of the terminals 5 and 6 are 0.6 mm wide and the distance from the bottom of the housing 8 to the ends of the terminals 5 and 6 in FIGS. 4 and 7, respectively, is 3.6 mm while the distance between said ends in the same Figures is 4.5 mm. The distance between said ends of the terminals 5 in FIG. 5 is 6.5 mm while the distance between the ends of the terminals 6 in FIG. 8 is 2.55 mm. The total height of the switch from the bottom of the housing 8 to the top of the activating element 11 is 4.3 mm. The diameter of the top of the activating element 11 is 2 mm. The contact element 12 consists of silver plated tin-bronze and the distance from its lowest portion in FIG. 9 to the top of the contact nibs 7 is 0.7 mm. The activating element 11 consists of silicone rubber. The housing consists of PPS and has outer dimensions of 4 mm by 4 mm in FIGS. 3 and 6.

The method according to the invention can be employed for a variety of other types of switches such as rotary switches, toggle switches, on-off switches etc. where a housing is attached to a set of terminals and switching means are installed in and/or on the housing. The method can also be employed in a variety of cases where the same basic switch has different applications requiring different geometrical configurations of the terminals, different widths and thereby electrical resistances and so on. The number of sub-sets and thereby different applications may be more than two. It would be obvious to those skilled in the art how to apply the principles of the invention to a series of technical problems of this type.

Similar observations are valid with respect to the switch according to the invention as the principles of said switch can be applied to a variety of other types of switches such as rotary switches, toggle switches, on-off switches etc. The switch according to the invention can also be employed in a variety of cases where the same basic switch has different applications requiring different geometrical configurations of the terminals, different widths and thereby electrical resistances and so on. The amount of sub-sets and thereby different applications may be more than two.

The method according to the invention is the more advantageous the more different manufacturing steps are to be performed when producing a particular switch.

Although the keyboard switch housing described with reference to the drawings has a square cross section in a plane parallel to the plane of the sheet, the same principles of the invention will apply to such a switch with any other suitable cross section shape, for instance circular, rectangular and so on. Naturally, said keyboard switch or other switches having multiple uses may also be manufactured in processes utilizing per se known methods, for instance one switch at a time or one row of switches from a narrow strip of conductive material.

What is claimed is:

1. A method of producing an electrical switch comprising a housing at least partially enclosing switching means for cooperating with a set of at least two metallic terminals, each terminal having an exterior portion outside the housing and an interior portion inside the housing, the method comprising:

providing a substantially planar sheet of a base metal of said terminals, removing portions of the sheet so as to form within the boundaries thereof at least two rows of said sets of metallic terminals and so that each terminal remains attached to the sheet solely at an end of the exterior portion of each terminal farthest from the interior portion thereof, attaching a plurality of housings to the sets in the sheet, installing the switching means in each of the housings, separating said end of each of the exterior portions of each set provided with the housings and the switching means from the sheet, and wherein the housings are attached to each of one or more sets in all of the rows substantially simultaneously, and the switching means are subsequently installed in each of the housings in one or more steps, each of said steps being performed in one or more housings of all of the rows substantially simultaneously.

2. A method according to claim 1, wherein the housings is attached to each of the sets by being moulded around the metallic terminals of the set.

3. A method according to claim 1, wherein the sets are disposed in the sheet in an array constituted by substantially parallel, rectilinear rows of sets extending in a first direction and by further substantially parallel, rectilinear rows of sets extending in a second direction substantially at right angles to the first direction.

4. A method according to claim 3, wherein the sheet of base metal is substantially rectangular, the rows of sets of terminals being substantially parallel to the sides of the substantially rectangular sheet.

5. A method according to claim 1, wherein apertures for guiding and positioning the sheet during the steps of attaching the housings, installing the switching means and separating the sets from the sheet are provided along the edges of the sheet and in at least some of the regions between the sets.

6. A method according to claim 1, wherein each set of terminals comprises at least two sub-sets, each sub-set corresponding to a different application of the switch, the method comprising a further step in which at least a portion adjacent said end of the exterior portion of each of the terminals of the sub-set or sub-sets of each set not relevant for the current application of the switch is separated from the rest of the terminal and thereby from the completed switch.

7. A method according to claim 6, wherein the different applications of the switch consist in different spacings between the electrical connection points of said ends of the exterior portions of the terminals of the individual sub-sets to exterior electrical circuitry.

8. A method according to claim 7, wherein the housings have a square section in a plane parallel to the plane of the sheet, the exterior dimensions of the square section being 4 mm wide and 4 mm long and wherein the set of terminals comprises a first sub-set corresponding to an application of a keyboard switch with a square section with exterior dimensions of 6 mm by 6 mm, and a second sub-set corresponding to an application of a keyboard switch with a square section with exterior dimensions of 4 mm by 4 mm.

9. A method according to claim 7, wherein the switching means of a keyboard switch comprise a contact element for electrically interconnecting at least two of the terminals in a first position of said contact element and interrupting said electrical interconnection in a second position, an activating element for moving the contact element from its second to its first position, a resiliently deformable member arranged for cooperation with the activating element such that it is resiliently deformed when the contact element is in its first position and is undeformed when the contact element is in its second position, and a key element connected to the activating element, said key element being arranged for being operated by a fingertip of a user of a keyboard, the activating element, the deformable member and the key element constituting an integral unit made from a resiliently deformable material.

10. A method according to claim 9, wherein the contact element, prior to installing the switching means in the housings, is fixedly attached to or integral with said unit, by partially embedding the contact element in the material of the unit.

11. A method according to claim 1, wherein the switch is a keyboard switch.

12. A method according to claim 11, wherein the sheet constitutes a strip that can be wound on and off a roll.

* * * * *